US010787726B2

(12) United States Patent
Park et al.

(10) Patent No.: US 10,787,726 B2
(45) Date of Patent: Sep. 29, 2020

(54) DUCTILE IRON COMPOSITION AND PROCESS OF FORMING A DUCTILE IRON COMPONENT

(71) Applicant: GENERAL ELECTRIC COMPANY, Schenectady, NY (US)

(72) Inventors: Junyoung Park, Greer, SC (US); Ibrahim Ucok, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 963 days.

(21) Appl. No.: 15/142,323

(22) Filed: Apr. 29, 2016

(65) Prior Publication Data

US 2017/0314104 A1 Nov. 2, 2017

(51) Int. Cl.

| | |
|---|---|
| ***C22C 37/10*** | (2006.01) |
| ***C21D 5/14*** | (2006.01) |
| ***C21D 5/00*** | (2006.01) |
| ***C21C 1/10*** | (2006.01) |
| ***C22C 33/06*** | (2006.01) |

(Continued)

(52) U.S. Cl.

CPC ..... *C22C 37/10* (2013.01); *C21C 1/105* (2013.01); *C21D 5/00* (2013.01); *C21D 5/14* (2013.01); *C22C 33/06* (2013.01); *C22C 33/10* (2013.01); *C22C 37/04* (2013.01); *C22C 37/06* (2013.01); *C21D 9/32* (2013.01); *C21D 2211/004* (2013.01); *C21D 2211/005* (2013.01); *C21D 2211/009* (2013.01)

(58) Field of Classification Search

CPC ..... C22C 37/10; C22C 33/10; C22C 37/04; C22C 33/06; C22C 37/06; C21D 5/00; C21D 5/14; C21D 2211/005; C21D 9/32; C21D 2211/004; C21D 2211/009; C21C 1/105

See application file for complete search history.

(56) References Cited

U.S. PATENT DOCUMENTS 3,549,430 A 12/1970 Kies et al.
3,702,269 A 11/1972 Church
(Continued)

FOREIGN PATENT DOCUMENTS

EP 2 468 903 A1 6/2012
EP 2465952 A1 6/2012
WO WO-2008112720 A1 * 9/2008 ..... C21D 5/00

OTHER PUBLICATIONS

Hayrynen, K.L., and Brandenberg, K.R., "Carbidic Austempered Ductile Iron (CADI)—The New Wear Material," American Foundry Society, pp. 1-6 (2003).

(Continued)

*Primary Examiner* — John A Hevey

(74) *Attorney, Agent, or Firm* — McNees Wallace & Nurick LLC

(57) ABSTRACT

A ductile iron composition including, by weight:
about 3.4% to about 4.0% Si;
about 3.0% to about 3.5% C;
about 0.5% to about 1.0% Cr;
about 0.02% to about 0.05% Mo;
up to about 0.01% S;
up to about 0.5% Mn; and
balance iron and incidental impurities.

The composition has a a ferritic body center cubic microstructure and has a graphite nodule density of greater than 100 per $mm^2$. A method for forming a ductile iron composition is also disclosed.

17 Claims, 1 Drawing Sheet

(51) Int. Cl.

| | |
|---|---|
| ***C22C 33/10*** | (2006.01) |
| ***C22C 37/04*** | (2006.01) |
| ***C22C 37/06*** | (2006.01) |
| ***C21D 9/32*** | (2006.01) |

(56) References Cited

U.S. PATENT DOCUMENTS

| | | | | | |
|---|---|---|---|---|---|
| 3,965,962 | A | | 6/1976 | Tanaka et al. | |
| 4,391,636 | A | | 7/1983 | Windish | |
| 4,484,953 | A | | 11/1984 | Kovacs et al. | |
| 4,702,886 | A | * | 10/1987 | Kent | C22C 37/04 420/13 |
| 4,767,278 | A | * | 8/1988 | Enderlein, Jr. | B63H 1/14 416/241 B |
| 4,880,477 | A | | 11/1989 | Hayes et al. | |
| 5,028,281 | A | | 7/1991 | Hayes et al. | |
| 5,139,579 | A | | 8/1992 | Kovacs et al. | |
| 6,883,235 | B2 | * | 4/2005 | Bell | B21K 1/30 29/893.1 |
| 8,540,932 | B2 | * | 9/2013 | Genma | C22C 33/10 420/15 |
| 2007/0134149 | A1 | | 6/2007 | Koike et al. | |
| 2008/0260568 | A1 | * | 10/2008 | Shah | C22C 37/04 420/16 |
| 2011/0017364 | A1 | | 1/2011 | Park et al. | |
| 2015/0284830 | A1 | | 10/2015 | Fay et al. | |
| 2015/0376747 | A1 | | 12/2015 | Tyou et al. | |

OTHER PUBLICATIONS

Extended European Search Report and Opinion issued in connection with corresponding EP Application No. 17168427.7 dated Aug. 9, 2017.

* cited by examiner

DUCTILE IRON COMPOSITION AND PROCESS OF FORMING A DUCTILE IRON COMPONENT

FIELD OF THE INVENTION

The present invention is directed to ductile iron composition, articles including the ductile iron compositions, and processes of forming ductile iron. More specifically, the present invention is directed to a solid solution strengthened ductile iron having increased toughness and wear resistance.

BACKGROUND OF THE INVENTION

Due to their wear resistance, strength, toughness, castability and machinability, ductile iron (cast nodular iron) alloys have also been used to produce a variety of wind turbine, gas turbine and mining components. The strength of cast iron has been improved remarkably by the development of spheroidal graphite cast iron, i.e. ductile cast iron, but its ductility and impact resistance are still behind those of the steel, making steel the desirable material for a variety of components, including gearbox components. To improve the mechanical properties of ductile iron, attempts at refining of the graphite nodules of the alloying of special elements have been made, but not succeeded yet in obtaining sufficient results. In addition, these compositions and processes may have such disadvantages as complicated or energy intensive processing.

BRIEF DESCRIPTION OF THE INVENTION

In an exemplary embodiment of the present disclosure, a ductile iron composition including by weight:

about 3.4% to about 4.0% Si;
about 3.0% to about 3.5% C;
about 0.5% to about 1.0% Cr;
about 0.02% to about 0.05% Mo;
up to about 0.01% S;
up to about 0.5% Mn; and
balance iron and incidental impurities.

The composition has a a ferritic body center cubic microstructure and has a graphite nodule density of greater than 100 per $mm^2$.

In another embodiment of the present disclosure, a method of forming a ductile iron component. The method includes forming a melt of a charge alloy, nodularizing the melt with a nodularizing alloy, inoculating the melt with an inoculation alloy to nucleate graphite nodules and form a ductile iron component and includes a ductile iron composition comprising, by weight:

about 3.4% to about 4.0% Si;
about 3.0% to about 3.5% C;
about 0.5% to about 1.0% Cr;
about 0.02% to about 0.05% Mo;
up to about 0.01% S;
up to about 0.5% Mn; and
balance iron and incidental impurities;

The composition includes a ferritic body center cubic microstructure and has a a ferritic body center cubic microstructure and has a graphite nodule density of greater than 100 per $mm^2$.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Provided is an exemplary ductile iron composition and a process of forming the ductile iron component having a plurality of predetermined properties. Embodiments of the present disclosure, in comparison to methods and products not utilizing one or more features disclosed herein, increased toughness, increased wear resistance or combinations thereof. The desirable wear resistance of the materials according to the present disclosure are particularly suitable for wind turbine, gas turbine and mining components, such as gear components, toes on buckets, crushers and other suitable components The terms "first," "second", and the like, herein do not denote any order, quantity, or importance, but rather are used to distinguish one element from another, and the terms "a" and "an" herein do not denote a limitation of quantity, but rather denote the presence of at least one of the referenced item. The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25%, or, more specifically, about 5% to about 20%", is inclusive of the endpoints and all intermediate values of the ranges of "about 5% to about 25%," etc.).

The modifier "about" used in connection with a quantity is inclusive of the stated value and has the meaning dictated by the context, (e.g., includes the degree of error associated with measurement of the particular quantity). For example, a quantitative value indicated as being about a number may vary by about +/−10%.

In one embodiment, the disclosure includes a process for the production of a wide variety of components from ductile iron compositions. Other non-limiting examples include gas turbine, wind turbine, automotive or oil and gas components, such as shafts, gears, axles, and various other components used in the energy, automotive, railroad, construction, mining and agricultural industries. Other components may include gearbox components, ring gears, planetary gears, and mining equipment. Such components are well known in the art and therefore require no further description.

Figure 1:
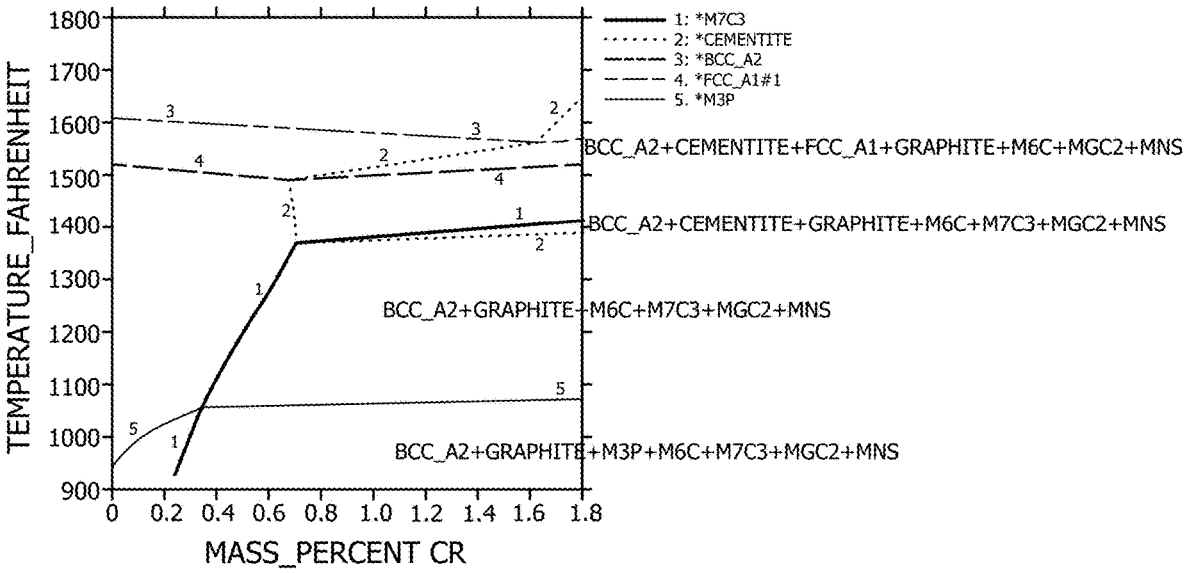
FIG. 1 is a graph showing carbide formation in the composition according to the present disclosure.

Ductile iron composition, according to embodiments of the present disclosure, contain, by weight, about 3.4% to about 4.0% silicon, about 3.0% to about 3.5% carbon, about 0.5% to about 1.0% chromium, about 0.02% to about 0.05% molybdenum, up to about 0.01% sulfur, up to about 0.5% manganese, and balance iron and incidental impurities. As known in the art, the level for carbon is necessary for graphite formation and castability considerations. The role of silicon is generally to promote the formation of graphite instead of metastable iron carbide during solidification. The carbon content separates as spheroidal graphite during solidification, primarily as the result of the presence of silicon. The spheroidal graphite imparts such desirable properties as high strength and toughness for which ductile iron alloys are known. In addition, in the composition according to the present disclosure chromium and molybdenum act as primary carbide formers (e.g., M6C and M7C3 type carbides). In one embodiment, the composition is devoid of nickel. FIG. 1 shows carbide formation for the composition according to the present disclosure.

In a further embodiment, the ductile iron composition includes about 3.5% to about 3.9% silicon, about 3.1% to about 3.4% carbon, about 0.6% to about 0.9% chromium, about 0.03% to about 0.04% molybdenum, up to about 0.01% sulfur, up to about 0.4% manganese, and balance iron and incidental impurities.

In a further embodiment, the ductile iron composition includes about 3.6% to about 3.8% silicon, about 3.25% to about 3.35% carbon, about 0.7% to about 0.8% chromium, about 0.03% to about 0.04% molybdenum, up to about 0.01% sulfur, up to about 0.3% manganese, and balance iron and incidental impurities.

Figure 2:
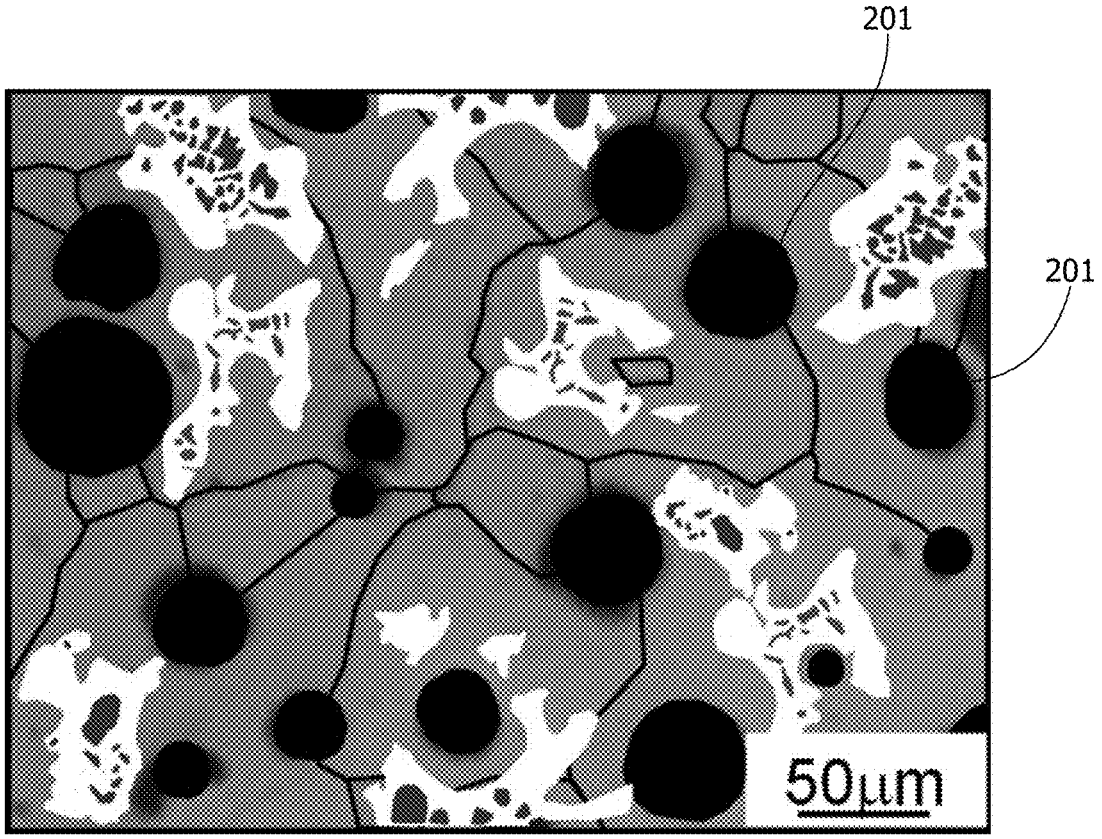
FIG. 2 shows a microstructure of a composition according to the present disclosure.

The ductile iron composition, according to the present disclosure, includes graphite nodules having varied spherical geometries. The microstructure of the ductile iron composition includes a substantially ferritic structure containing less than 5 areal % pearlite or less than 15 areal % pearlite. In certain embodiments of the disclosure, the mechanical properties vary based upon thickness of the component. For example, components having wall thicknesses of equal to or less than 2 inches include less than 5 areal % or less than 2 areal % or less than 1 areal % pearlite. Components having wall thicknesses of equal to or less than 4 inches include less than 15 areal % or less than 10 areal % or less than 7.5 areal % pearlite. The microstructure of the ductile iron composition includes carbide volumetric percentage between about 5% and about 20% or between about 5% and about 15% or about 10%. In one embodiment, the nodule density for highly spherical and substantially spherical graphite nodules is greater than 100 per $mm^2$ or greater than 125 per $mm^2$ or 150 per $mm^2$. An exemplary microstructure is shown in FIG. 2, wherein the graphite nodules 201 are visible.

The ductile iron composition, according to the present disclosure, is formed treating a charge material with a specific composition to nodularize and inoculate the charge composition. The method includes forming a melt of a charge material. The charge material is any suitable material for forming the melt. Suitable mixtures for the charge material include a composition having 20-40% in-house return, 30-50% pig iron, 10-20% steel scrap. The composition is selected to result in the desired alloy composition after nodularization and inoculation. After the melt is formed, the charge composition is nodularized with a nodularizing composition. Nodularizing includes contacting the charge material with a nodularizing composition. The nodularizing composition is a material that nodularizes graphite within the ductile iron composition to form graphite nodules.

In one embodiment, the nodularizing composition comprises, by weight, from about 1.0% to about 1.4% of the charge alloy and nodularizing composition. In one embodiment, the nodularizing composition includes two portions, including a first portion and a second portion. In this embodiment, the first portion comprises, by weight, about 0.2 to about 2.0% Al, about 0.2 to about 2.0% Ca, about 0.2 to about 2.0% rare earth elements, 2.0 to about 4.0% Mg and balance essentially FeSi. The second portion of the nodularizing composition includes, by weight, of the first portion about 0.2 to about 2.0% Al, about 0.2 to about 2.0% Ca, less than about 0.1% rare earth elements, 2.0 to about 4.0% Mg and balance essentially FeSi.

To form the ductile iron composition, according to the present disclosure, the composition is inoculated. Inoculation is accomplished by contacting an inoculating composition with the charge material. Inoculation may occur at various stages of the process. For example, inoculating may be done in the furnace, in the ladle, at other stages in the formation process or in combination of these points in the process. Inoculating the charge material with the inoculating composition nucleates the graphite nodules and assists in the formation of a higher nodule density with desired nodule geometry. One composition suitable for use as an inoculating composition includes a ferrosilicon composition comprising, by weight, of the composition about 0.2 to about 2.0% Al, about 0.2 to about 2.0% Ca, and about 1.0 to about 2.0% Ce.

The ductile iron composition, according to the present disclosure, after nodularization and inoculation, is cast using casting techniques known in the art for casting.

The ductile iron composition may be heat treated to induce formation of carbides. In one embodiment, the ductile composition is heat treated at a temperature between about 1350° F. and 1425° F., to form a microstructure as shown in FIG. 2. Time for heat treatment may vary according to effective thickness of the component. For example, the component may be heat treated for a time or about 1 hour per inch of effective thickness of the component.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A ductile iron composition, consisting of, by weight:
about 3.4% to about 4.0% Si;
about 3.0% to about 3.5% C;
about 0.5% to about 1.0% Cr;
about 0.02% to about 0.05% Mo;
up to about 0.01% S;
about 0.3% to about 0.5% Mn; and
balance iron and incidental impurities;
wherein the ductile iron composition includes a ferritic body center cubic microstructure and has a graphite nodule density of greater than 100 per $mm^2$; and
wherein the ductile iron composition is devoid of Ni.

2. The ductile iron composition of claim 1, wherein the ductile iron composition consists of, by weight:
about 3.5% to about 3.9% Si;
about 3.1% to about 3.4% C;
about 0.6% to about 0.9% Cr;
about 0.03% to about 0.04% Mo;
up to about 0.01% S;
about 0.3% to about 0.4% Mn; and
balance iron and incidental impurities.

3. The ductile iron composition of claim 1, wherein the ductile iron composition includes microstructure containing less than 15 areal % pearlite.

4. The ductile iron composition of claim 1, wherein the ductile iron composition includes microstructure containing less than 5 areal % pearlite.

5. The ductile iron composition of claim 1, wherein the ductile iron composition includes microstructure containing carbide volumetric percentage between about 5% and about 20%.

6. The ductile iron composition of claim 1, wherein the graphite nodule density is greater than 125 per $mm^2$.

7. The ductile iron composition of claim 1, wherein the graphite nodule density is greater than 150 per $mm^2$.

8. A component comprising the ductile iron composition, according to claim 1.

9. The component of claim 8, comprising a component selected from the group consisting of gearbox components, ring gears, planetary gears, and mining equipment.

10. A method of forming a ductile iron component, the process comprising:

forming a melt of a charge alloy;

nodularizing the melt with a nodularizing alloy;

inoculating the melt with an inoculating composition to nucleate graphite nodules and form the component comprising a ductile iron composition consisting of, by weight:

about 3.4% to about 4.0% Si;

about 3.0% to about 3.5% C;

about 0.5% to about 1.0% Cr;

about 0.02% to about 0.05% Mo;

up to about 0.01% S;

about 0.3% to about 0.5% Mn; and balance iron and incidental impurities;

wherein the ductile iron composition includes a ferritic body center cubic microstructure and has a graphite nodule density of greater than 100 per $mm^2$; and wherein the ductile iron composition is devoid of Ni.

11. The method of claim 10, wherein the nodularizing composition comprises, by weight:

a first portion comprising, by weight, of the first portion:

about 0.2 to about 2.0% Al;

about 0.2 to about 2.0% Ca;

about 0.2 to about 2.0% rare earth elements;

2.0 to about 4.0% Mg; and balance essentially FeSi and incidental impurities; and second portion comprising, by weight:

about 0.2 to about 2.0% Al;

about 0.2 to about 2.0% Ca;

less than about 0.1% rare earth elements;

2.0 to about 4.0% Mg; and balance essentially FeSi and incidental impurities.

12. The method of claim 11, wherein the nodularizing composition comprises, by weight, from about 1.0% to about 1.4% of the charge alloy and nodularizing composition.

13. The method of claim 10, wherein the inoculating composition includes a ferrosilicon composition comprising, by weight, about 0.2 to about 2.0% Al, about 0.2 to about 2.0% Ca, and about 1.0 to about 2.0% Ce.

14. The method of claim 10, further comprising heat treating the component at a temperature and for time sufficient to induce formation of carbides in the ductile iron composition.

15. The method of claim 14, further comprising heat treating the component at a temperature between about 400° C. and 600° C.

16. The method of claim 14, wherein the ductile iron composition includes microstructure containing carbide volumetric percentage between about 5% and about 20%.

17. The method of claim 10, wherein the ductile iron composition includes microstructure containing less than 15 areal % pearlite.

* * * * *